United States Patent [19]

Chapman

[11] Patent Number: 4,989,847

[45] Date of Patent: Feb. 5, 1991

[54] CLAMPING DEVICE

[76] Inventor: Grant Chapman, 817 Mt. Adams, Boardman, Oreg. 97818

[21] Appl. No.: 406,261

[22] Filed: Sep. 12, 1989

[51] Int. Cl.[5] ..... B25B 5/02

[52] U.S. Cl. ..... 269/170

[58] Field of Search ..... 269/165-171.5, 269/147-150, 6

[56] References Cited

U.S. PATENT DOCUMENTS

| | | | |
|---|---|---|---|
| 1,739,488 | 12/1929 | Thayer | 269/166 |
| 1,811,518 | 6/1931 | Palmer | 269/166 |
| 3,224,752 | 12/1965 | Benbow | 269/6 |
| 4,057,239 | 11/1977 | Hopf et al. | 269/170 |
| 4,081,112 | 3/1978 | Chang . | |
| 4,185,811 | 1/1980 | Long . | |
| 4,220,322 | 9/1980 | Hobday . | |
| 4,339,113 | 7/1982 | Vosper | 269/147 |
| 4,436,294 | 3/1984 | Irelan . | |

FOREIGN PATENT DOCUMENTS

| | | | |
|---|---|---|---|
| 2326546 | 12/1974 | Fed. Rep. of Germany | 269/167 |
| 2806555 | 8/1979 | Fed. Rep. of Germany | 269/168 |

OTHER PUBLICATIONS

Popular Science, Aug., 1989, p. 79.

*Primary Examiner*—Robert C. Watson

*Attorney, Agent, or Firm*—Kolisch, Hartwell & Dickinson

[57] ABSTRACT

An improved bar-clamp apparatus includes an elongate bar which has a first clamping jaw affixed adjacent one end of the bar. A carrier is mounted for selective reversible movement on and along the bar. A second clamping jaw faces the first jaw and is mounted on a carrier for movement therewith and relative thereto. A one-hand-actuatable drive mechanism is connected to the carrier and is actuatable to drive the carrier along the bar towards an end thereof.

6 Claims, 2 Drawing Sheets

CLAMPING DEVICE

BACKGROUND OF THE INVENTION

The invention relates to clamping devices, and specifically to a clamping device which includes a one-hand operable drive mechanism.

Clamping devices, particularly those used in the fields of woodworking and materials assembly, are well known. The normal type of bar-clamp generally includes a fixed clamping jaw and a movable clamping jaw, wherein the movable clamping jaw may be adjusted to clamp materials of a different thicknesses. Typically, the movable clamping jaw is slidable on a bar extending between the jaws and will include some mechanism for fixing the jaw in place on the bar. Additionally, a clamping head on the movable clamping jaw may be adjustable by means of a threaded shaft and handle.

Although the known devices are suitable for some of their intended purposes, they generally require two-handed operation and include rather bulky mechanisms, which precludes their being inserted in confined areas. One-handed operation is deemed important because the user of a clamp as described herein is frequently working alone and must hold two or more pieces of material in positions relative to one another while installing a clamp on the material. Obviously, if operation of the clamp requires two hands an inordinate amount of manual dexterity and speed is required to secure the working pieces in place while installing the clamp thereon.

Another short coming of the known clamps is the inability to easily change the position of the movable jaw once the clamp is installed on the workpieces. Generally, only a head mounted on a threaded shaft may be shifted once the clamp is installed.

An object of the invention is to provide a bar-clamp apparatus which has a one-hand-actuatable drive mechanism on a moving clamping jaw thereof.

Another object of the invention is to provide a bar-clamp device which is easily insertable in confined spaces.

A further object of the invention is to provide a bar-clamp device which is suitable for both compressive clamping and expansive clamping.

Yet another object of the invention is to provide a bar-clamp apparatus which has a first clamping jaw which is installable on either end of the bar thereof.

Still another object of the invention is to provide a one-hand-actuatable movable jaw which is retrofitable on existing clamps.

SUMMARY OF THE INVENTION

The improved bar-clamp apparatus of the invention includes an elongate bar which has a first clamping jaw affixed adjacent one end of the bar. A carrier is mounted for selective reversible movement on and along the bar. A second clamping jaw faces the first jaw and is mounted on a carrier for movement therewith and relative thereto. A one-hand-actuatable drive mechanism is connected to the carrier and is actuatable to drive the carrier along the bar towards an end thereof.

These and other objects and advantages of the invention will become be more fully apparent as the description which follows is read in conjunction with the drawings.

DETAILED DESCRIPTION OF THE PREFERRED EMBODIMENTS

Figure 1:
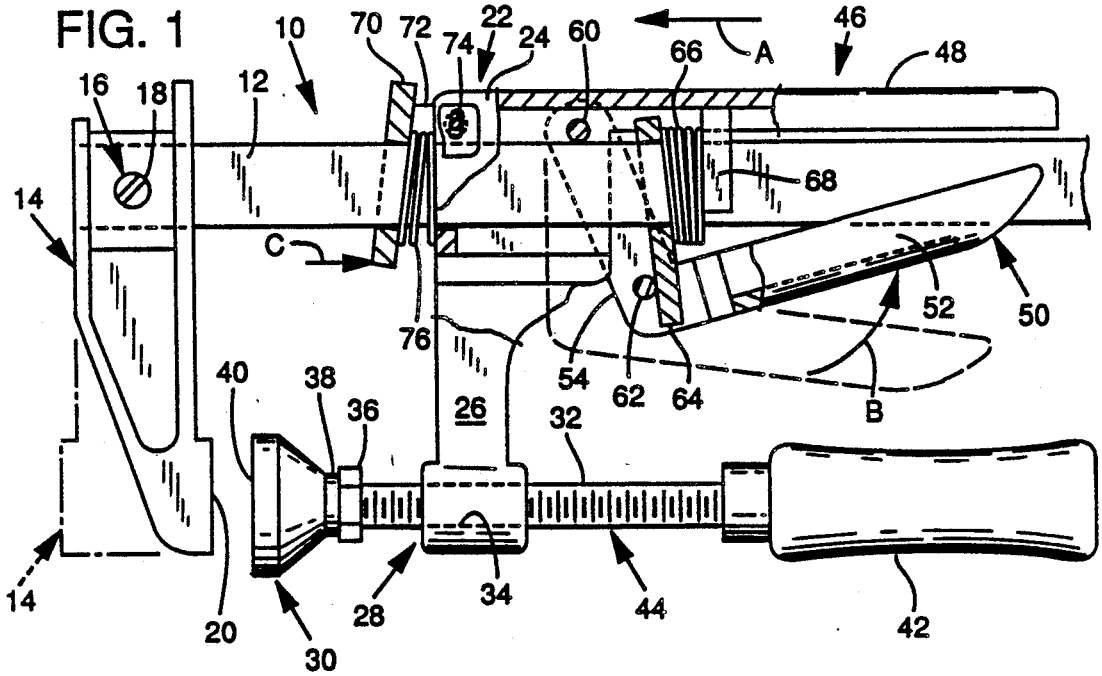
FIG. 1 is a top plan view of a bar-clamp apparatus constructed according to the invention, with portions broken away to show detail.
Figure 2:
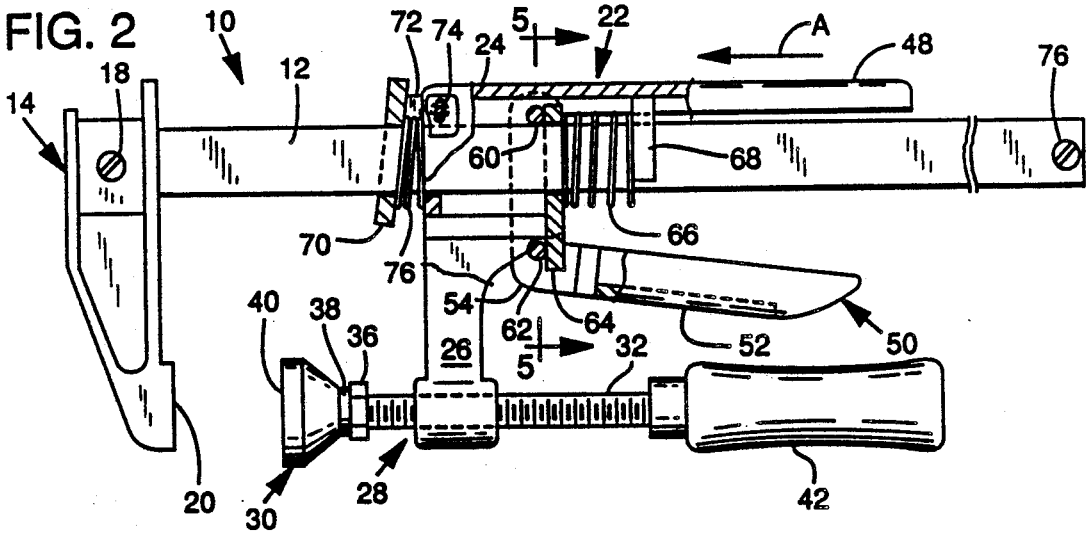
FIG. 2 is a top plan view the clamp of FIG. 1 depicting a trigger-lever thereof in a neutral position, with portions of the apparatus broken away to show detail.

Referring now to the drawings, and initially to FIGS. 1 and 2, an improved bar-clamp apparatus is shown generally at 10. Apparatus 10 includes an elongate bar 12 which has a substantially rectangular cross section.

A first clamping jaw 14 is secured to one end of bar 12 by means of a removable fixing means 16, which, in the preferred embodiment, includes a threaded retainer 18 and a bore (not shown) which extends through bar 12. Clamping jaw 14 includes a clamp head 20, which in this embodiment faces towards the other end of bar 12. As will be discussed later herein, clamping jaw 14 may be formed with a single clamp head 20 or may have dual heads, as depicted in phantom lines in FIG. 1.

Bar clamp 10 includes a carrier 22 which is mounted on bar 12 for selective, reversible movement on and along the bar. Carrier 22 includes a carrier body 24 and a carrier arm 26 which extends outwardly from the carrier body and is substantially parallel to, and projects to the same side of the bar as first clamping jaw 14. A second clamping jaw 28 is mounted on carrier arm 26 and is capable of movement with the arm and also relative to the arm. Second clamping jaw 28 includes a second clamp head 30 which is carried on a threaded shaft 32, which in turn is received in a threaded bore 34, located on the distal portion of carrier arm 26. Second clamping head 30 is attached to threaded shaft 32 by means of a threaded receiver 36. The second clamping head has a pivotable mount 38 between receiver 36 and a compacting portion of the head 40, which faces clamp head 20 on first clamping jaw 14. A handle 42 is provided to rotate shaft 32, thereby moving second clamping head 30 relative to carrier arm 26. Threaded receptacle 34, shaft 32 and handle 42 comprise what is herein referred to as second clamping jaw adjustment mechanism 44.

Figure 5:
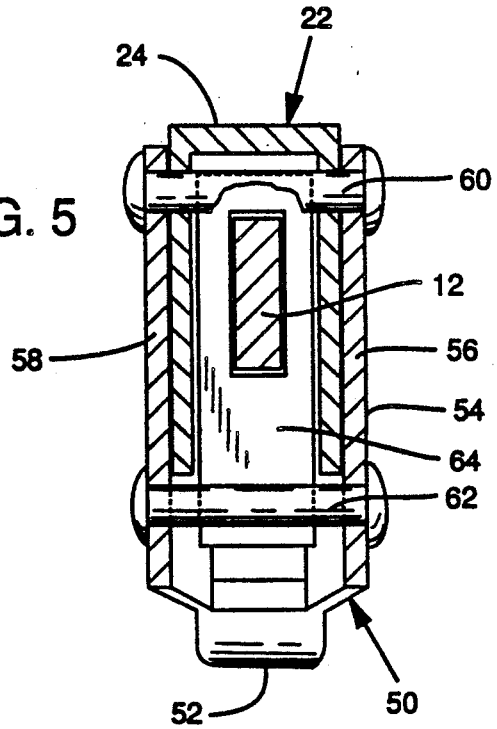
FIG. 5 is a cross section of the bar-clamp apparatus taken generally along the line 5—5 of FIG. 2.

Carrier 22 includes a drive mechanism 46. Drive mechanism 46 includes a body extension 48 which extends outward from carrier body 24 substantially parallel to bar 12 on one side thereof. Extension 48 is also referred to herein as a non-pivoted trigger/lever. A pivoted trigger/lever or handle 50 is depicted in a drive position in FIG. 1 and in a neutral position in FIG. 2. Trigger/lever 50 is disposed on the opposite side of bar 12 from extension 48 and includes a trigger portion 52 and an actuator portion 54. Referring now to FIGS. 1, 2, and 5, actuator portion 54 has a pair of opposed, spaced part sides 56, 58 which extend along either side of carrier body 24. Actuator portion 54 is pivotably secured to carrier body 24 by means of a pivot pin 60, which passed through the actuator sides and the carrier body. A drive, or grip pin 62 also passes through actuator sides 56, 58 and contacts a drive grip 64.

Referring now to FIG. 2, with lever 50 in a neutral position, drive grip 64 contacts both pivot pin 60 and drive grip pin 62 and is biased in such a position by a drive grip spring 66 which presses against drive grip 64 at one end thereof and is held in place about bar 12 at the other end thereof by a drive-grip-spring retainer 68, which is attached to body extension 48.

To briefly explain the workings of the drive mechanism as disclosed so far, with lever 50 in the neutral position, as depicted in FIG. 2, carrier 22 is free to slide along the length of bar 12 in the direction indicated by arrow A in FIGS. 1 and 2. With the lever squeezed towards bar 12, as depicted by arrow B in FIG. 1, drive grip 64 pinches the narrow edges of bar 12, thereby jamming itself into a locked position on the bar. As lever 50 is moved towards bar 12, drive grip pin 62 acts on a side of drive grip 64, thereby shifting carrier 22 along bar 12 in the direction indicated by arrow A. A release of pressure on trigger portion 52 allows drive-grip spring 66 to act on drive grip 64 and drive grip pin 62, thereby extending lever 50 back to its neutral position. The lever may again be squeezed in the direction of arrow B, thereby further moving carrier 22 along bar 12.

With the components of carrier 24 thus far described, it is apparent that the carrier may move in either direction of the length of bar 12. However, one purpose of the invention is to provide a compression force on a workpiece. To that end, a releasable position-holding grip 70 is provided and is pivotably attached to carrier body 24 by means of a pair of flanges 72 and a holding-grip pin 74, which extends through the flanges and a bore in carrier body 24. Holding grip 70 is maintained in a holding position by a holding-grip spring 76. The holding grip is constructed such that the carrier may be freely moved in the direction of arrow A, but will not move in the direction opposite that of arrow A without releasing holding grip 70, which may be accomplished by depressing the end of holding grip 70 opposite flange 72 in the direction indicated by arrow C. With the holding grip depressed, carrier 22 may once again move in either direction along the length of bar 12. An advantage of the carrier of the invention is that such a carrier may be retrofitted onto an existing clamp, such as those manufactured by Adjustable Clamp Co. of Chicago, Illinois.

Figure 3:
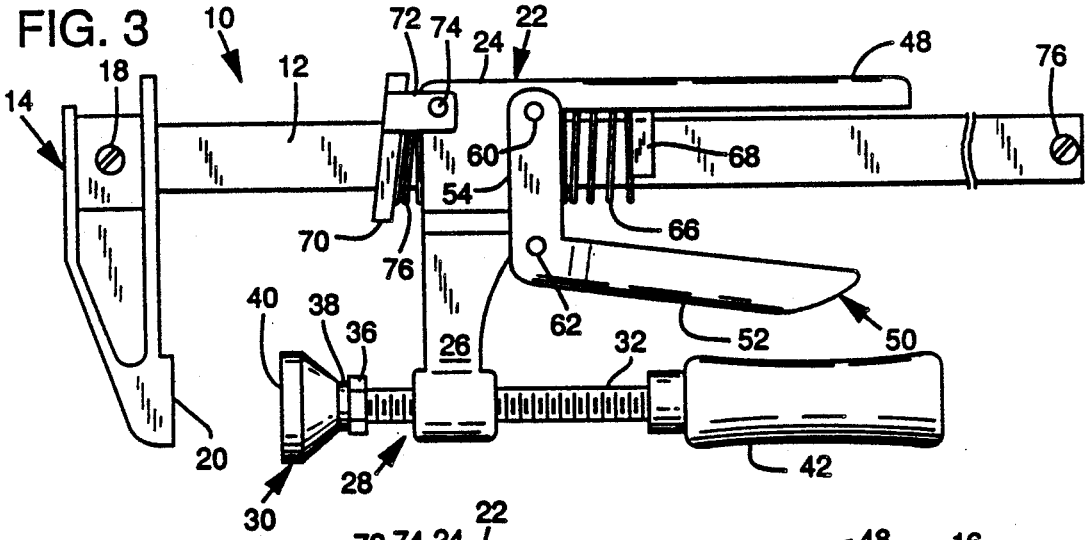
FIG. 3 is a top plan view of the apparatus.

Referring now to FIG. 1, a reversed first clamping jaw is shown in phantom lines and depicts the appearance of the bar clamp as it would appear following the steps of removing threaded retainer 18, reversing first clamping jaw 14 such that clamp head 20 faces 180 degrees from the direction shown in solid lines, and reinstalling threaded retainer 18. As previously noted, a bar clamp is generally used to compress a workpiece or several workpieces together. There are many occasions, however, when it would be desirable to use the bar clamp to expand a workpiece, or to apply pressure to a workpiece from a stationary object. To this end, the bar clamp is provided with a removable first clamping jaw, which maybe rotated by 180 degrees, and by removing a retainer 76 as depicted in the FIGS. 2 and 3, carrier 22 may be removed from the other end of bar 12 and reinstalled with the second clamping jaw facing 180 degrees from its original position. The carrier would then move in a direction opposite that indicated by arrow A, away from first clamping jaw, thereby providing a clamping force directed away from the interior portion of bar 12.

Figure 4:
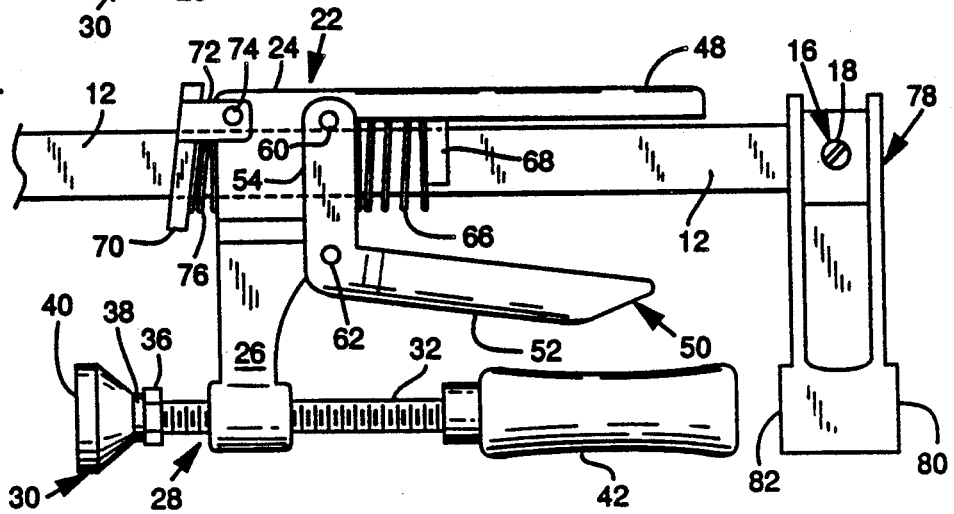
FIG. 4 is a top plan view of the apparatus having a modified form of clamping jaw depicted thereon.

Referring now to FIG. 4, a second embodiment of a first clamping jaw is depicted at 78. Clamping jaw 78 includes a pair of opposed, spaced apart clamp heads 80, 82 which face in directions opposite one another. In this embodiment of the invention, first clamping jaw 78 may be shifted from one end of bar 12 to the other to provide expansion clamping forces. This configuration eliminates the necessity of removing and reinstalling carrier 22 on bar 12.

An important feature of the invention is the ability to operate by clamp 10 with one hand. The clamp may be initially set up with the first clamping jaw and second clamping jaw spaced apart by a distance approximating that of the workpieces to be clamped therein by sliding carrier 22 along bar 12 away from the first clamping jaw. Handle 42 will generally be rotated such that second clamping head 30 is relatively close to carrier arm 26, thereby allowing for significant adjustment of the clamp with second clamping jaw adjustment mechanism 44. The workpieces may then be placed between the first and second clamping jaws, held in place by one hand of the user and the second clamping jaw moved by means of the drive mechanism to secure the workpieces between the clamping jaws of the bar clamp. Carrier 22 may be moved along the length of bar 12 by a ratcheting type action of the drive mechanism and drive grip 64 on bar 12. Once initial pressure is applied to the workpiece, the bar clamp may be let go of and the final adjustment may be made by applying twisting pressure to handle 42 and the remainder of the second clamping jaw adjustment mechanism. As more pressure is applied to the workpiece, holding grip 70 wedges against bar 12 to hold carrier 22 in place and provide a clamping force to the workpiece.

In order to release the bar clamp, handle 42 may be rotated to initially release pressure on the workpiece and when sufficient pressure has been released, holding grip 70 may be depressed in the direction indicated by arrow C, thereby allowing carrier 22 to move freely along bar 12. Similar procedures may be used to apply clamping force to a workpiece with the bar clamp arranged in an expansion producing configuration.

Another advantage of the clamp disclosed herein is that it may be used to provide a compressive or expansive force on a workpiece. If the clamp is provided with a dual head first clamping jaw, the carrier may be reversed or the jaw may be placed on the other end of the bar to provide expansive forces. With the single head first clamping jaw, the first clamping jaw may be moved to the other end of the bar or the carrier may be reversed to provide expansive clamping forces.

The small size of the carrier allows insertion of the clamp into restrictive spaces and still provides for one-hand operation of the clamp in such spaces.

Although a preferred embodiment of the invention, and variations thereof have been disclosed, and should be appreciated that further variations and modifications may be made to the invention without departing from the scope of the invention as defined in the appended claims.

What is claimed is:

1. An improved bar-clamp apparatus comprising:

an elongate bar;

a first clamping jaw affixed adjacent one end of said bar;

a carrier mounted for selective reversible movement on and along said bar;

a second clamping jaw facing said first jaw and mounted on said carrier for movement both therewith and relative thereto; and a trigger/lever, one-hand-actuatable drive mechanism drivingly connected to said carrier, actuatable to drive said carrier along said bar towards the bar's said one end, including a handle disposed on one side of said bar, and an elongate, pivoted trigger/level, whose long axis generally parallels that of said bar, disposed on the opposite side of said bar.

2. An improved bar-clamp apparatus comprising:

an elongate bar;

a first clamping jaw affixed adjacent one end of said bar and extending outwardly from a side of said bar substantially normal thereto;

a carrier mounted for selective reversible movement on and along said bar, said carrier including a carrier body which surrounds a stretch of said bar, a carrier arm extending outwardly from said carrier body substantially parallel to and on the same side as said first clamping jaw, and a drive mechanism for driving said carrier along said bar, said mechanism including a body extension extending outwardly from said body substantially parallel to said bar, a lever pivotably mounted on said carrier body and extending generally in the same direction as said body extension, said lever including a trigger portion and an actuator portion, said actuator portion having first and second bores therethrough, a lever pivot pin being received in one bore in the lever and in a bore in said carrier body, a drive grip pin being received in the other actuator portion bore, and a drive grip constructed and arranged to contact said lever and said bar to drive said carrier along said bar in a first direction towards an end of said bar, wherein said drive grip is spring biased to a first, neutral position and wherein said drive grip is shiftable by said lever to a drive position wherein said drive grip grips said bar, said drive grip remaining in a stationary position, and wherein said lever acts on said stationary drive grip thereby moving said carrier and wherein said drive-grip pin riding on said drive grip to shift said drive grip between said neutral position and said drive position; and a second clamping jaw mounted on said carrier arm for movement therewith and relative thereto.

3. The apparatus of claim 2 which includes removable fixing means for securing said first clamping jaw to said bar, and wherein said bar includes first-clamping-jaw fastening means at both ends thereof, said first clamping jaw having opposed, spaced apart heads which face in opposite directions from one another.

4. The apparatus of claim 2 wherein said carrier further includes a releasable position-holding grip attached thereto to prevent movement of said carrier in a direction opposite of said first direction.

5. An improved bar-clamp apparatus comprising:

an elongate bar having a first clamping jaw fastening means adjacent at least one end thereof;

a first clamping jaw having at least one clamping head thereon affixed adjacent one end of said bar;

a carrier reversibly mounted for movement in a selected direction along the bar, said carrier including a drive mechanism thereon which is constructed and arranged to drive said carrier along said bar in a first direction towards an end thereof, said drive mechanism including a drive grip which is mounted on said bar, an actuator to shift said drive grip from a neutral position to a driving position, and a position holding grip, which prevent movement of said carrier along said bar in a direction opposite said first direction, and a trigger lever which is pivotably mounted on said carrier and which acts on said drive grip to move said carrier in said first direction; and a second clamping jaw mounted on said carrier and having a clamping head thereon, a second clamping jaw adjustment mechanism having a carrier arm extending outwardly from said carrier, a threaded shaft having said second clamping jaw carrier thereon and received in rotatably, adjustably received in said carrier, and a handle for adjusting the position of said second clamping jaw relative to said carrier, said second clamping head being aligned with said first clamping head.

6. The apparatus of claim 5 wherein said first clamping jaw has opposed, spaced apart clamping heads thereon, said heads facing in direction opposite one another, and wherein said carrier is reversible on said bar to provide for movement in a direction towards said second clamping jaw, for compressing material located between said first and second jaws, and alternately to provide movement in a direction away from said second clamping jaw, for expanding material trained over said first and second clamping jaws.

* * * * *